US006576851B1

(12) United States Patent
Barlian et al.

(10) Patent No.: US 6,576,851 B1
(45) Date of Patent: Jun. 10, 2003

(54) SWITCHING DEVICE

(75) Inventors: Reinhold Barlian, Bad Mergentheim (DE); Karl-Heinz Lux, Weikersheim (DE)

(73) Assignee: Bartec Componenten und Systeme GmbH, Mergentheim (DE)

( * ) Notice: Subject to any disclaimer, the term of this patent is extended or adjusted under 35 U.S.C. 154(b) by 121 days.

(21) Appl. No.: 09/688,602

(22) Filed: Oct. 16, 2000

(30) Foreign Application Priority Data

Oct. 14, 1999 (DE) ..... 199 49 565

(51) Int. Cl.[7] ..... H01H 3/32

(52) U.S. Cl. ..... 200/5 R; 200/17 R; 200/18; 200/330; 200/501

(58) Field of Search ..... 200/17 R, 18, 200/5 R, 11 R, 47, 501, 50.01–50.4, 330

(56) References Cited

U.S. PATENT DOCUMENTS 3,015,705 A * 1/1962 Dull ..... 200/501 X
3,369,100 A * 2/1968 Kussy et al. ..... 200/330
3,793,496 A * 2/1974 Kimura et al. ..... 200/18
4,171,472 A * 10/1979 Elliott ..... 200/47
4,340,789 A * 7/1982 Williams ..... 200/11 R
4,371,820 A * 2/1983 Kruger ..... 200/501 X
4,713,498 A * 12/1987 Ludwig et al. ..... 200/5 R
4,954,832 A * 9/1990 Grant et al. ..... 342/352
5,111,009 A * 5/1992 Chan et al. ..... 200/330
5,200,586 A * 4/1993 Smith et al. ..... 200/50.32

FOREIGN PATENT DOCUMENTS

DE 9401016.1 U1 * 6/1994 ..... H01H/3/40
EP 0211075 B1 * 2/1987 ..... H01H/19/64
EP 211075 B1 * 5/1990 ..... H01H/19/64
GB 2355590 A * 4/2001 ..... H01H/3/32

* cited by examiner

*Primary Examiner*—J. R. Scott
(74) *Attorney, Agent, or Firm*—Horst M. Kasper

(57) ABSTRACT

A switching device includes two or more switching modules (7, 8, 15) with at least one switch and connection clamps (24), an actuator (16), and a transfer device (39). The transfer device (39) propagates the drive motion initiated by the actuator (16) in a direction perpendicular to the axis of the actuator (16) and transfers the drive motion to at least one switching pin (18, 19) of the switching modules (7, 8, 15). The switching pin (18, 19) is positionable axially at a distance parallel to the axis of the actuator (16).

45 Claims, 9 Drawing Sheets

SWITCHING DEVICE

BACKGROUND OF THE INVENTION

1. Field of the Invention

The present invention relates to a switching device for a switching of switches.

2. Brief Description of the Background of the Invention Including Prior Art

A switching device is taught in the Printed Patent Document European EP 0211075 B1, which switching device includes a disk, by way of which disk several parallel shafts are rotatable simultaneously by same amounts, wherein a first drive device is attached at a disk and wherein a second drive device is attached to a carrier and is coupled to the first drive device such that the actuation of one of the two drive devices brings the disk to turn in a prescribed way.

A switching device for chaff cutters, circular saws and similar machines is known from the German Printed Patent Document DE 9401016 U1, wherein the switching device interrupts a current supply upon opening of certain casing parts and also upon overloading. The switching device exhibits an outer actuating member, wherein the position of the outer actuating member is to correspond to the state of the electrical switching device, wherein a gear wheel is furnished for the connection of setting member and setting device, which gear wheel is effective in the two switching directions.

SUMMARY OF THE INVENTION

1. Purposes of the Invention

It is an object of the present invention to create a low height constructed switching device, by way of which several switches can be switched reliably and precisely as selected.

These and other objects and advantages of the present invention will become evident from the description which follows.

2. Brief Description of the Invention

The present invention provides a switching device comprising a plurality of switching modules, wherein each switching module includes a switch, connection clamps, an actuator, a transfer device, wherein the transfer device propagates a drive motion initiated by the actuator in a direction perpendicular to the axis of the actuator, and a switching pin, wherein the transfer device transfers the drive motion to the respective switching pin of the switching module, wherein the switching pin is axially shiftable and is disposed parallel to the axis of the actuator and at a distance from the actuator.

The actuator includes an actuating handle rotatable around the axis of the actuator and an actuating sleeve, wherein the actuating sleeve is pluggably coupled to the actuating handle. The actuating sleeve exhibits at least one stop web, wherein the stopweb is swivelable against at least one stop wall, wherein the stop wall is furnished at a closure cover. The actuating sleeve exhibits an actuating pin in axial direction, wherein the actuating pin penetrates the closure cover through a bore hole.

A closure cover, wherein the transfer device includes a drive gear wheel, and at least two switching gear wheels are disposed in a plane with the drive gear wheel and engaging with the drive gear wheel, wherein the switching gear wheels are rotatably supported at the guide pin in the closure cover. An actuating pin has a dog follower nose, wherein the actuating pin engages into a hole of the drive gear wheel and wherein the latter drive gear wheel includes at least one receiver groove for a coupling engagement of the dog follower nose of the actuating pin. The drive gear wheel includes drive teeth corresponding to gear teeth of the switching gear wheels and locking teeth disposed coaxially to the drive teeth, wherein at least one locking piece of a switching arrest engages into the locking teeth. A locking piece, and a closure cover can be provided, wherein the locking piece is supported in the closure cover with a compression spring acting radially against locking teeth of the drive gear wheel. A switching pin is associated with the switching module, and a pressure piece is coordinated to each switching gear wheel for the switching pin of the switching module and coordinated to each one of the at least two switching gear wheels. The switching gear wheel includes an about circular shaped switching crank with at least one switching recess at the side disposed toward a pressure piece, wherein the switching recess corresponds to a control cam of the pressure piece.

An intermediate wall can be furnished for guiding two pressure pieces and disposed between the two pressure pieces coordinated to one switching gear wheel. At least one guide web can engage into a guide groove for a slidable support of a pressure piece in the closure cover.

At least one of the two switching gear wheels includes different symbols for a selective switching coding, wherein the symbols of the switching gear wheel are disposed shaped as a circle within the switching crank, wherein at least one coding part for the symbols of the switching gear wheel is formed at a wall of the switching gear wheel. A casing can be provided for supporting the connection terminals. Two explosion protected switches are mounted such into a casing of the switching module that switching pins protruding out of the guide sleeves are resting with their free ends at pressure pieces of the transfer device.

A distance spacer can be disposed between switching modules, wherein the distance spacer includes a foot part with two sideways protruding support webs, wherein the support webs grip under a casing of the switching module, wherein the distance spacer includes an opening, wherein an actuating pin is guided in the opening, wherein the casing of the switching module and the distance spacer include locking openings for an engagement of locking hooks, wherein the locking hooks are formed at the closure cover. A closure cover includes a display opening at the end of a guide groove for an end part of a guide web formed at a pressure piece.

Additional advantages and the substantial details of the invention can be gathered from the following description and the drawing, which show in the schematic presentation preferred embodiments as an example.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
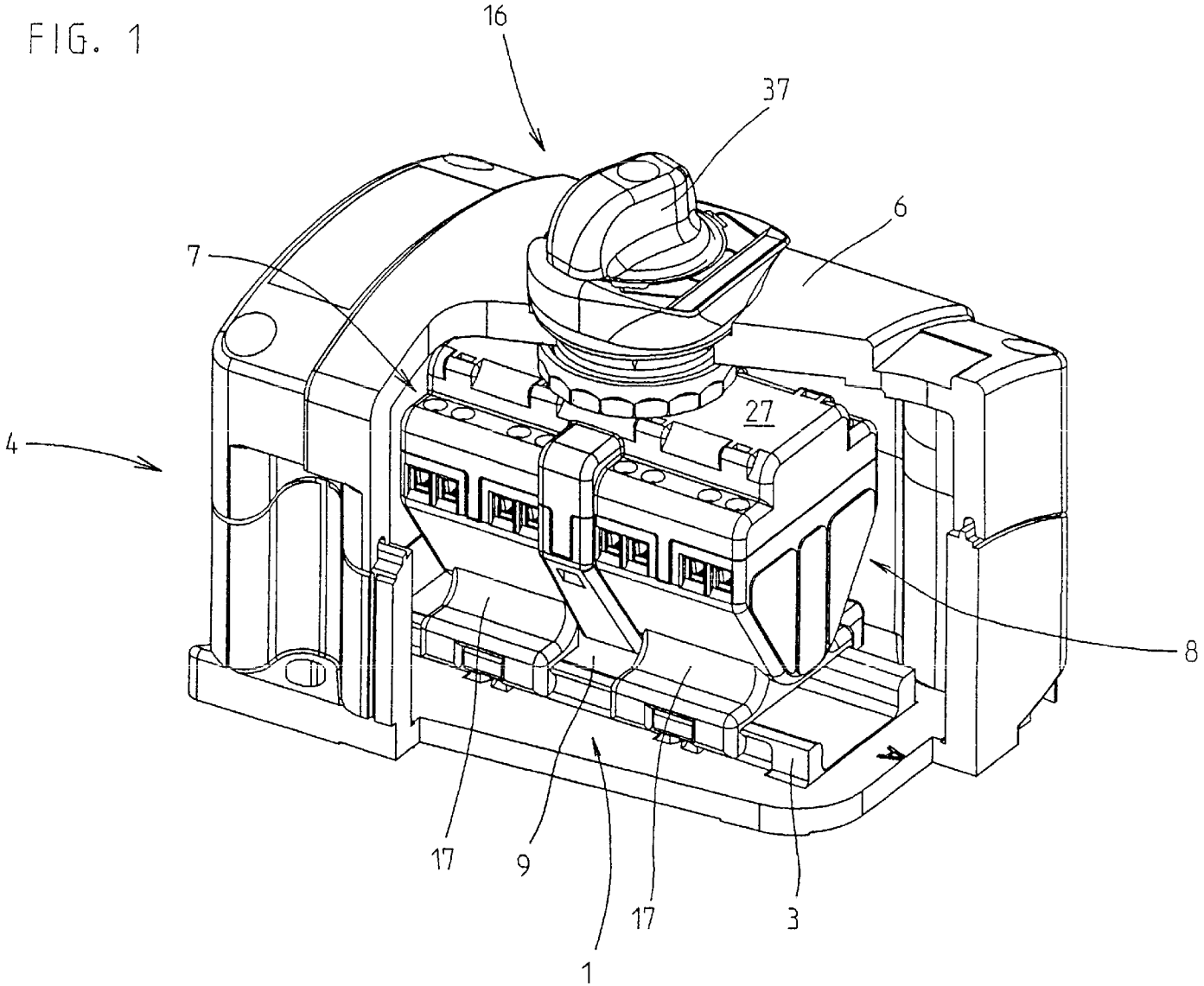
FIG. 1 shows a perspective and in part sectional view of the switching device according to the present invention and of its casing.

These switching devices 1, 2 according to the present invention illustrated in the drawing are furnished for an attachment at a mounting rail, wherein the mounting rail can be furnished in an casing 4 already commercially available or in a distributor casing 5, wherein the distance between the mounting rail 3 and the cover 6 of the casing 4 or, respectively, of the distributor casing 5 can be maintained relatively small, such that a flat or low level construction height results.

The construction height of the distributor casing 4 can be from about 0.5 to 0.9 times the construction width of the distributor casing 4.

Figure 2:
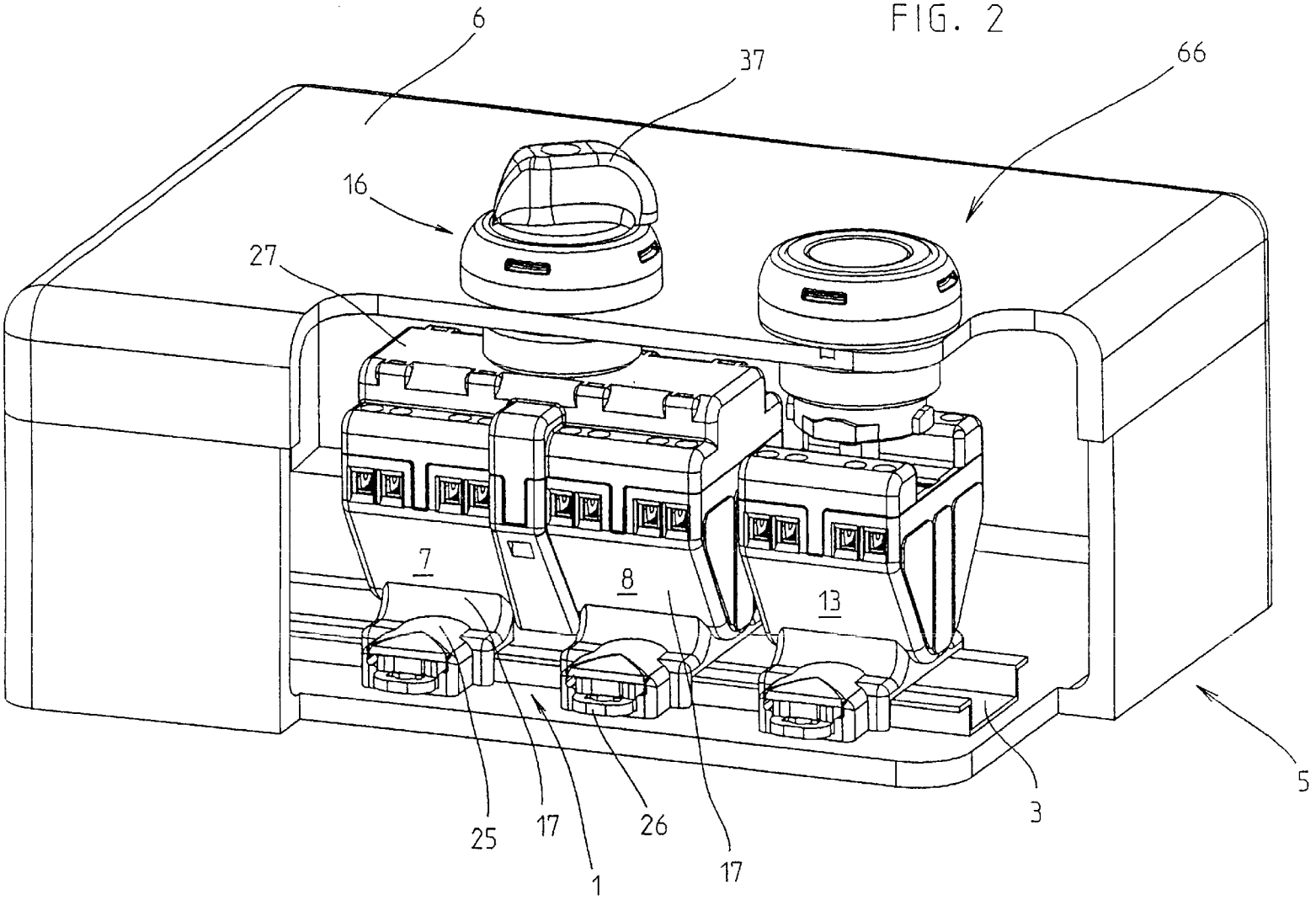
FIG. 2 shows a perspective view of the switching device according to FIG. 1 with a partially sectioned distributor casing containing a switching module with a pushbutton.

The switching device 1, 2 is modularly composed of several individual parts and exhibits two next to each other disposed switching modules 7, 8 in the embodiment of FIG. 1, wherein a spacer 9 is furnished between the switching modules 7, 8, which spacer 9 grips shape matching under the switching modules 7, 8 with the two support webs 11, 12 extending at its foot part 10 in opposite directions. The height of the switching modules 7, 8 can be less than the width of the switching modules 7, 8. It can be observed from FIG. 2 that further electrotechnical units, for example a switching module 13 actuable through a push button 66, can be furnished at the mounting rail 3 in the distributor casing 5 in addition to the switching device 1.

Figure 3:
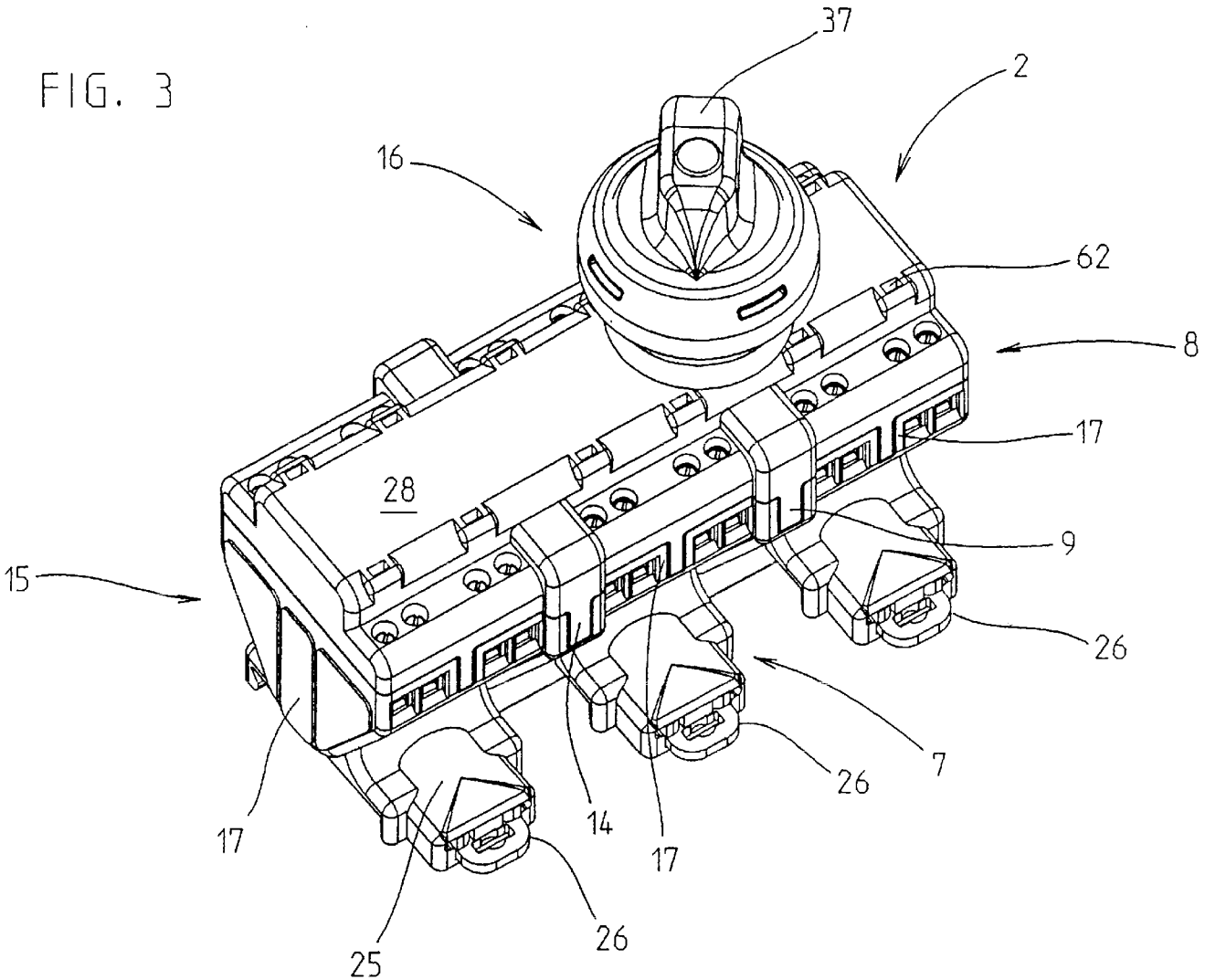
FIG. 3 shows a perspective view of a switching device similar to that of FIG. 1, however, including three switching modules.

The switching device 2 shown in the FIG. 3 comprises two distance spacers 9, 14 and three switching modules 7, 8, 15 disposed in series, wherein all switching modules 7, 8, 15 can be actuated through a single actuator 16 positioned in the region of the distance spacer 9. It is within the frame of the present invention to place in series in addition also less or more than three switching modules 7, 8, 15 and to switch these switching modules through a single actuator 16. The actuator 16 can rotate around its longitudinal axis. The construction height remains thereby unchanged low.

Figure 5:
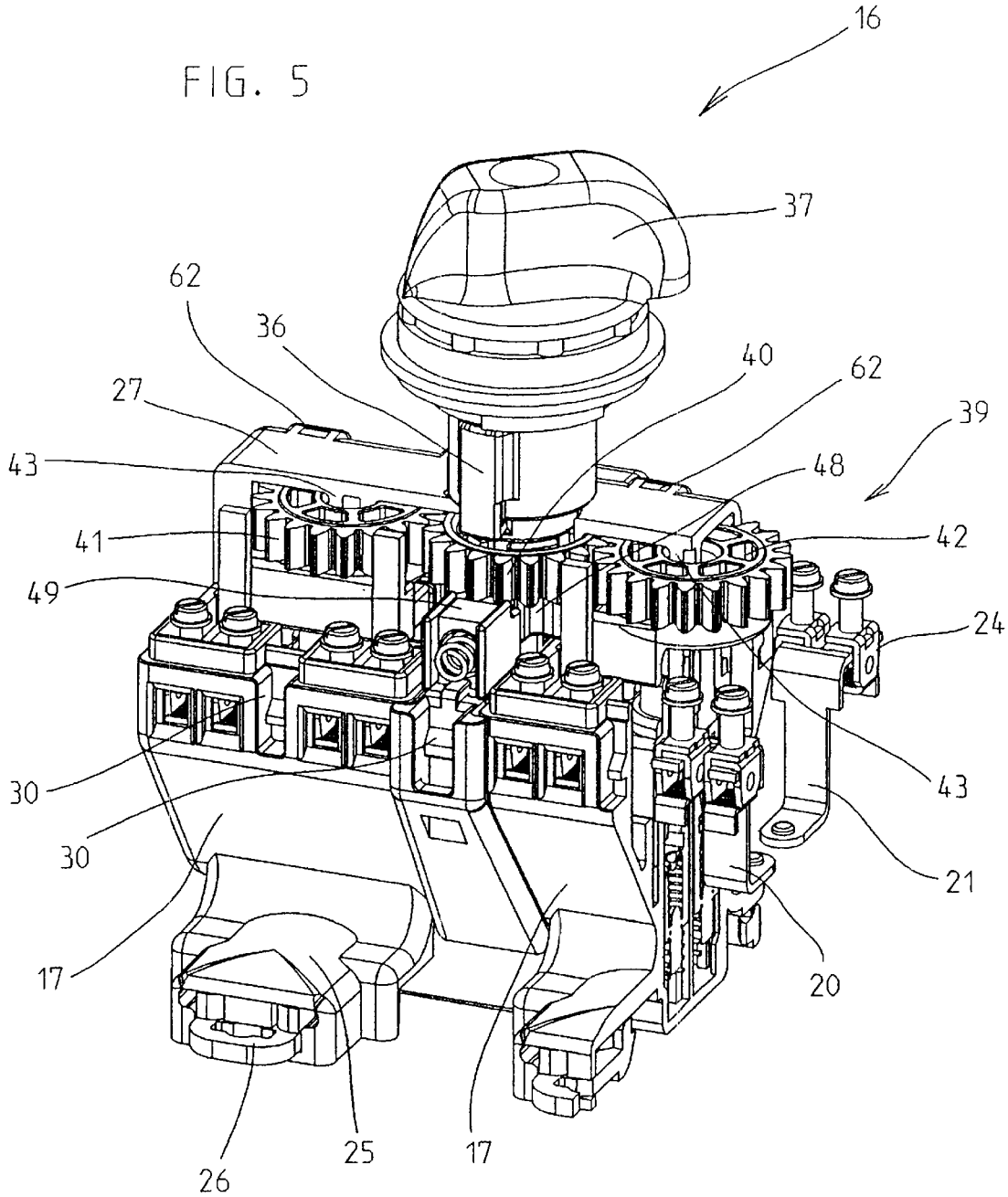
FIG. 5 shows an isometric and in part sectional presentation of the switching device of FIG. 1.

The switching modules 7, 8, 15 exhibit a casing 17, wherein two electrical switches are supported advantageously in the casing 17. The electrical switch also includes a movable switching bridge. The switching bridge serves to furnish a selective bridging of the fixedly disposed switching contacts 20, 21 (FIGS. 5, 6), which switching contacts 20, 21 are also part of the electrical switch. The electrical circuit is closed when the switching bridge bridges the switching contacts 20, 21.

Figure 6:
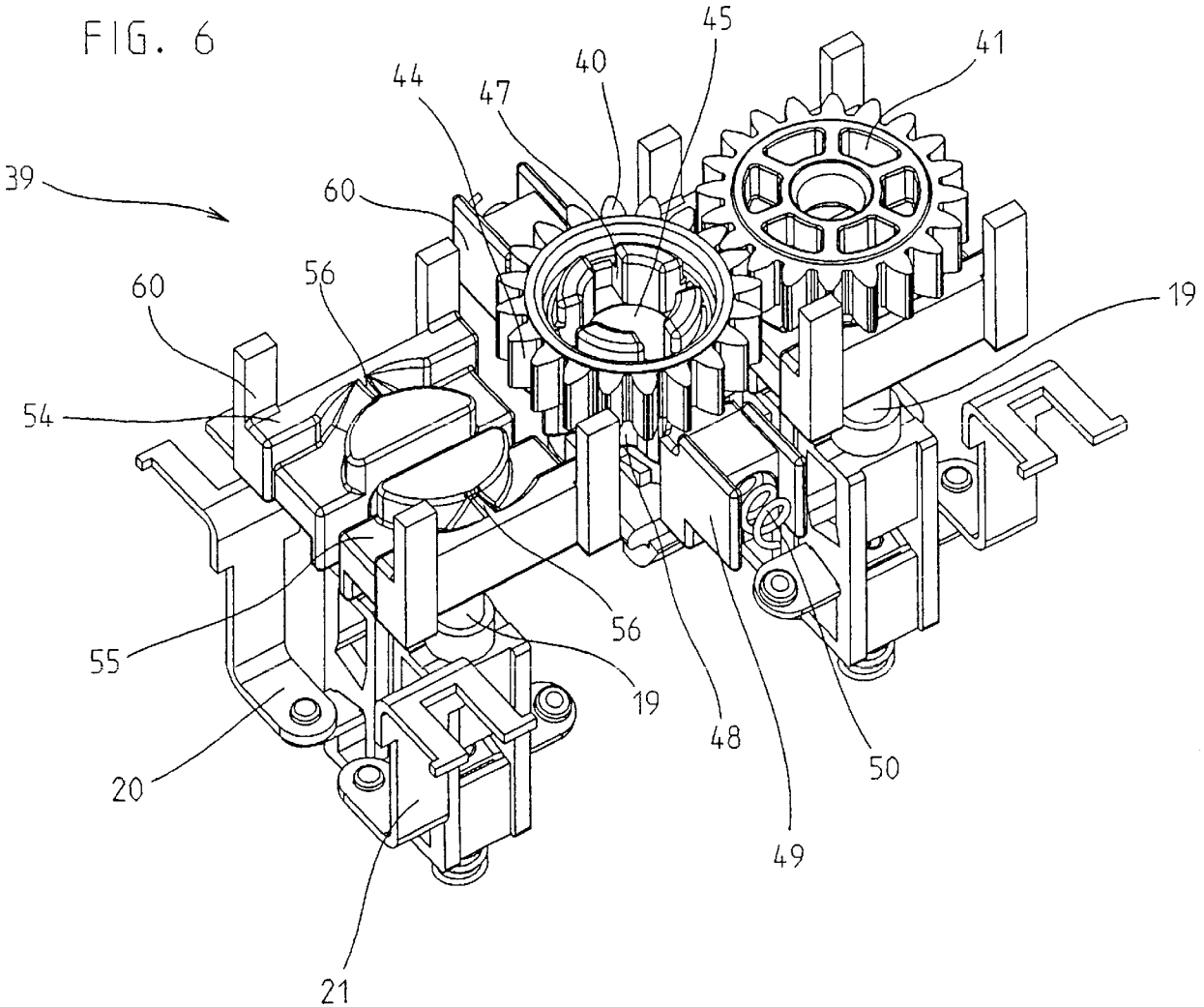
FIG. 6 shows an isometric view of the transfer device of the switching device according to FIG. 1 with a removed switching gear wheel and with the switching contracts of the switching device.
Figure 11:
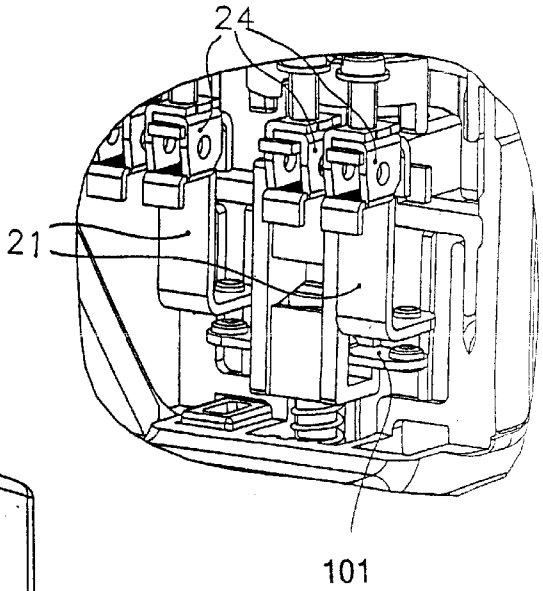
FIG. 11 shows a detail view of FIG. 10 with the switching bridge.
Figure 10:
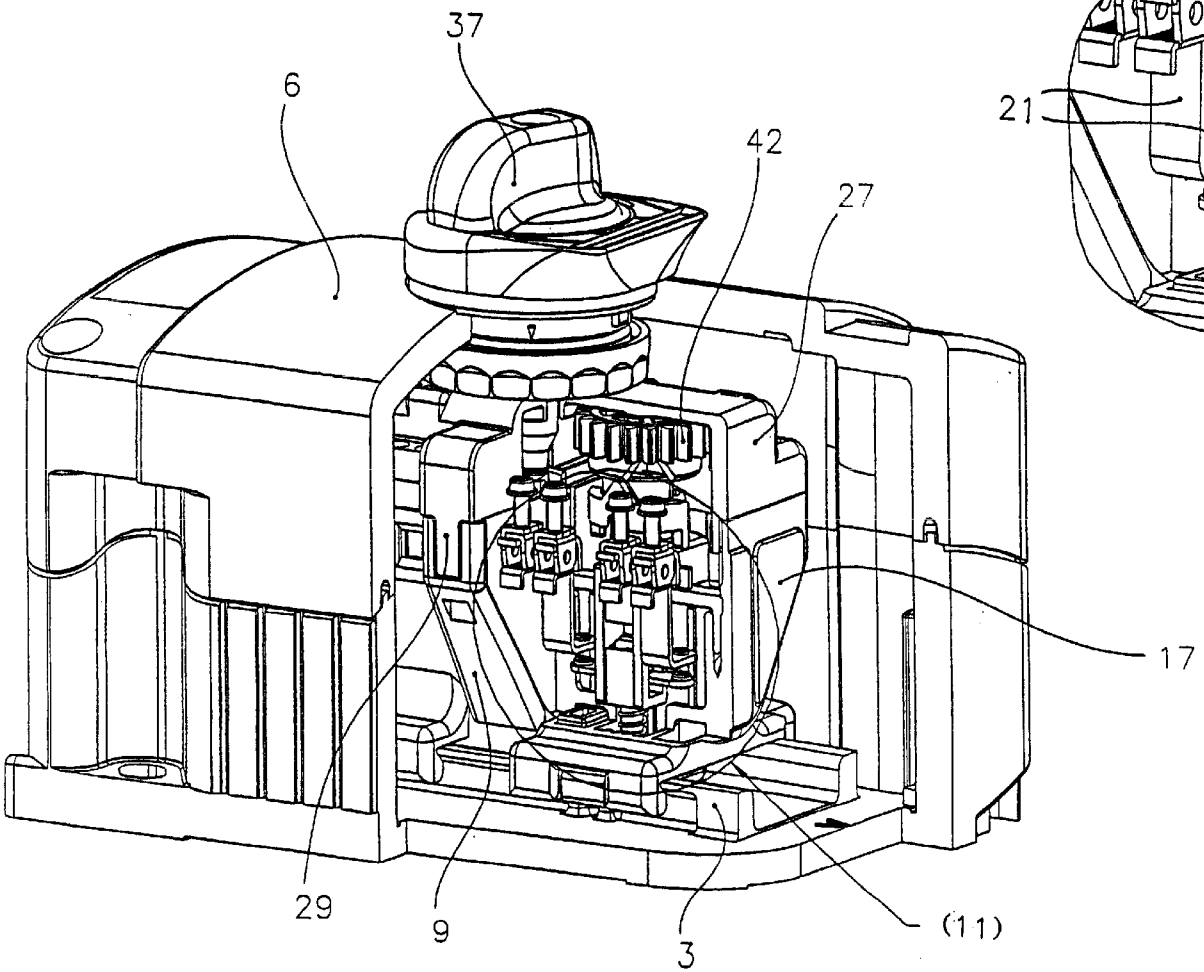
FIG. 10 shows a perspective and in parted broken open view of the switching device similar to FIG. 1, however with the switching bridge visible.

A switching pin 18 or a switching pin 19 is axially predisposed to each switch and is associated with each switch. The switching pins 18, 19 cooperate with a movable switching bridge 101 illustrated in FIGS. 10 and 11, wherein the movable switching bridge 101, as selected, bridges the fixed positioned switching contracts 20, 21 of each switch and thereby closes the electrical current circuit. The switching pins 18, 19 can be disposed slidable in guide sleeves 22, 23 (FIG. 4) of the switches. The switching pins 18, 19 are disposed at a distance away from the axis of the actuator 16. The axes of the switching pins 18, 19 are disposed in parallel to the axis direction of the actuator 16. The switching pins 18, 19 can be moved in a direction running parallel to the longitudinal axis of the switching pins 1 8, 19. The switches can be cast in the casing 17 by way of a casting resin such that a safe unit is provided in the sense of explosion protection. Connection clamps or terminals 24 are additionally provided in the casing 17 for connecting the electrical conductors, wherein the connection clamps or terminals 24 are connected to switching contacts 20, 21 (FIG. 6). A foot 25 can be formed at the base of the casing 17 for disengageable attachment of the switching module 7, 8, 15 at the mounting rail 3, wherein the foot 25 exhibits a slider 26 impacted by a spring force for lockingly engaging at the mounting rail 3.

The switching modules 7, 8, 15 coupled with the distance spacers 9, 14 are covered by a closure cover 27 (FIG. 2), 28 (FIG. 3), wherein the closure covers 27, 28 can exhibit locking hooks 29 (FIG. 4) at oppositely disposed side walls, wherein the locking hooks 29 shape matchingly engage the locking openings 30 (FIG. 4), wherein the locking openings 30 are formed at the casing 17 of the switching modules 7, 8, 15 and the distance spacers 9, 14. The closure cover 27, 28 exhibits a bore hole 31 (FIG. 4), wherein an actuating pin 33 (FIG. 4) disposed axially at an actuating sleeves 32 protrudes into the bore hole 31. Two part circle shaped stop walls 34, 35 can be formed at the outside of the closure cover 27, 28, wherein the actuating sleeve 32 together with a stop web 36 is supported limited swivelable between the stop walls 34, 35. The actuator 16 (FIG. 3) gripping over the actuating sleeve 32 is furnished with an actuating gripper 37 rotatable around an axis, wherein the axial end of the actuating gripper 37 engages into the actuating sleeve 32 (FIG. 4) and is thus pluggably coupled with this actuating sleeve 32. The free end of the actuating pin 33 directed downwardly in the drawing is rotatably supported in an opening 38 (FIG. 4) of the distance spacer 9, such that a reliable function of the actuator 16 is assured.

A transfer device 39 (FIG. 5) is disposed within the closure covers 27, 28, wherein the transfer device 39 includes a drive gear wheel 40 and at least two switching gear wheels 41, 42. More than two switching gear wheels 41, 42 are disposed within the switching device 2 which switching device 2 includes three switching modules 7, 8, 15. The switching gear wheels 41, 42 can be disposed rotating around guide pins 43, wherein the guide pins 43 are disposed protrudingly at the inner side of the closure cover 27, 28. The switching gear wheels 41, 42, which switching gear wheels 41, 42 are advantageously furnished at oppositely disposed sides of the drive gear wheel 40, are disposed about in one and the same plane as the latter drive gear wheel 40 and engage into the drive gearing 44 (FIG. 6) with their teeth.

The placement of the drive gear wheel 40 and of the switching gear wheels 41, 42 into one and the same plane results in a very low construction height. The construction height of the closure covers 27, 28 can be from about 0.4 to 0.6 times the construction width of the closure covers 27, 28 and the construction height of the closure covers 27, 28 can be from about 0.1 to 0.2 times the construction length of the closure covers 27, 28.

The drive gear wheel 40 is furnished in its middle with a hole 45 (FIG. 6), wherein the hole 45 is disposed coaxially relative to the bore hole 31 of the closure cover 27, 28 and wherein the actuating pin 33 penetrates through the hole 45. The coupling of the drive gear wheel 40 with the actuating pin 33 is performed through a driver dog 46 (FIG. 4) formed at the latter actuating pin 33, wherein the driver dog 46 is insertable as selected in one of preferably four receiver grooves 47 (FIG. 6) formed in the hole wall of the drive gear wheel 40. In addition the drive gear wheel 40 is furnished with locking teeth 48, wherein the locking teeth 48 are disposed coaxial to a drive gearing 44 in a plane disposed parallel to the drive gearing 44.

The locking teeth 48 (FIG. 6) exhibit a switching arrest, wherein the switching arrest comprises preferably two locking pieces 49 disposed opposite to each other, wherein the locking pieces 49 engage into the tooth spaces of the locking teeth 48 by way of a spring force. The wedge shaped locking pieces 49 supported slidable in the closure cover 27, 28 are impacted each such with a compression spring 50, whereby a problem free positioning is accomplished for the respective switching position.

Figure 7:
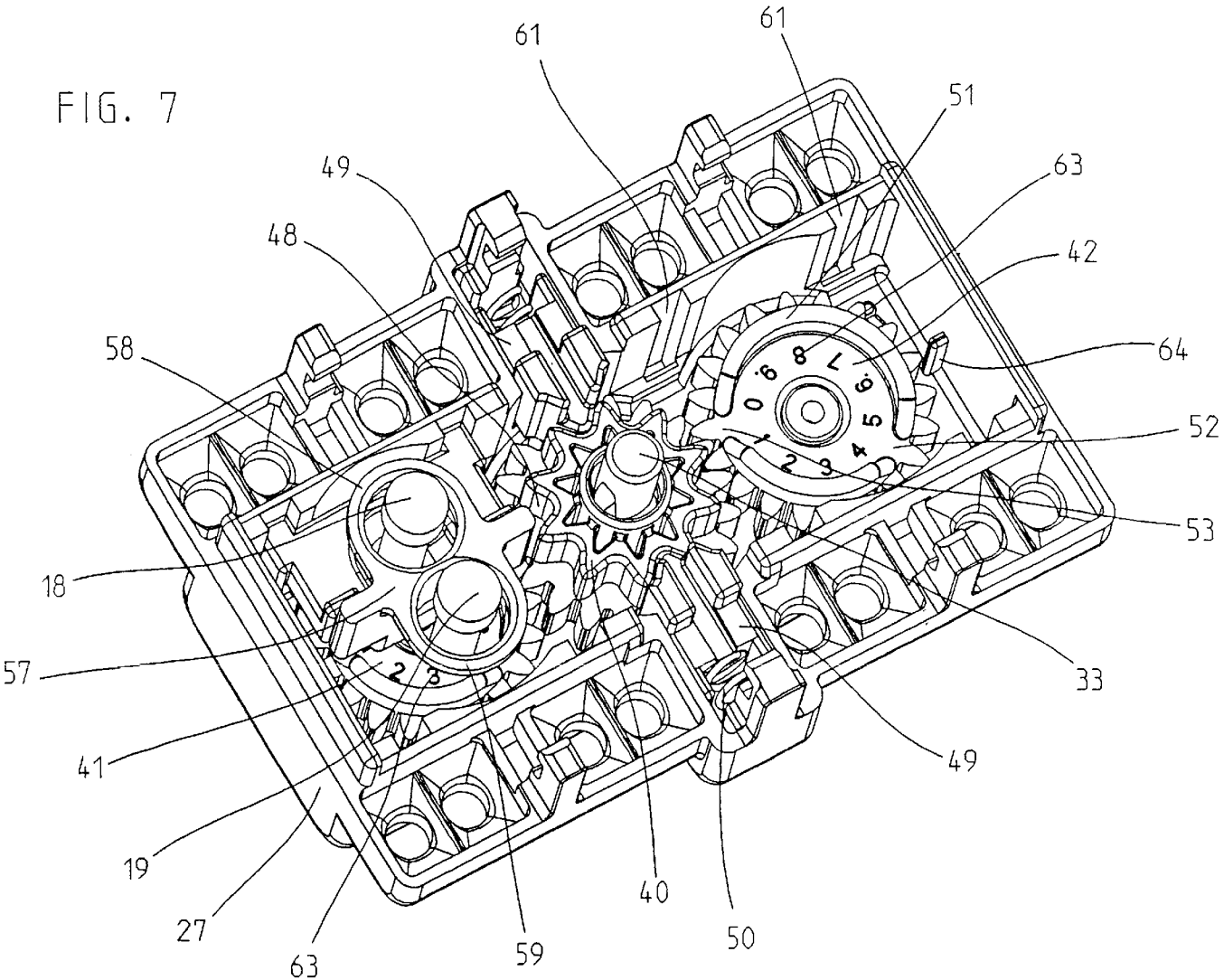
FIG. 7 shows an isometric bottom view of the closure cover of the switching device according to FIG. 1 with the integrated transfer device.

The switching gear wheels 41, 42 are furnished at their lower side disposed toward the switching pins 18, 19 of the switching modules 7, 8 with a switching crank 51 (FIG. 7), wherein the switching crank 51 is formed essentially as a circular shaped wall, wherein the circular shaped wall is interrupted by switching recesses 52, 53. The wall parts of the switching crank 51 delimiting the switching recesses 52, 53 can be produced advantageously as V-shaped formed inclined faces.

Two pressure pieces 54, 55 (FIG. 6) can be furnished at each switching crank 51 of the switching gear wheels 41, 42, wherein in each case one of the switching pins 18, 19 (FIGS. 4, 6, 7) with its free end is resting at the pressure pieces 54, 55. The pressure pieces 54, 55 exhibit a control cam 56 (FIG. 6), wherein the control cam 56 corresponds to the switching crank 51 and engages into the switching recess 52, 53 in case of a corresponding position of the actuator 16. An intermediate wall 57 disposed between the two pressure pieces 54, 55, wherein the intermediate wall exhibits two sideways extending away spring parts 58, 59 (FIG. 7) gripping over the pressure pieces 54, 55.

The pressure pieces 54, 55 themselves can exhibit guide webs 60, which guide webs 60 are slidably supported in the guide groove 61 (FIG. 7) of the closure cover 27, 28 (FIGS. 1, 2, 3, 5). The upper wall of the closure cover 27, 28 can be such broken out at the outer end of the guide grooves 61 (FIG. 7) such that display openings 62 (FIG. 3) are formed. If the control cam 56 of the pressure piece 54, 55 is disposed in the switching recess 52, 53 of the switching gear wheels 41, 42, then the free end piece of the guide web 60 protrudes into the display openings 62 such that the visual control of the switching position is possible from the outside.

The switching device 1, 2 can be set to a plurality of different switching combinations by staggering or, respectively, different arranging of the switching gear wheels 41, 42. The switching gear wheels 41, 42 can advantageously exhibit different symbols 63 for such selected switching coding, wherein the symbols 63 are furnished as numeral symbols from 0 to 9 disposed on a circle, wherein the numeral symbols are advantageously disposed within the switching crank 51. In order for being able to perform unequivocally and reproduceably the coding of the desired switching combination during mounting, advantageously web shaped coding parts 64, 65 can be formed at the inner side of a wall of the closure cover 27, 28, wherein the symbols 63 of the switching gear wheels 41, 42 can be positioned corresponding to the desired switching combination next to the coding parts 64, 65.

Figure 8:
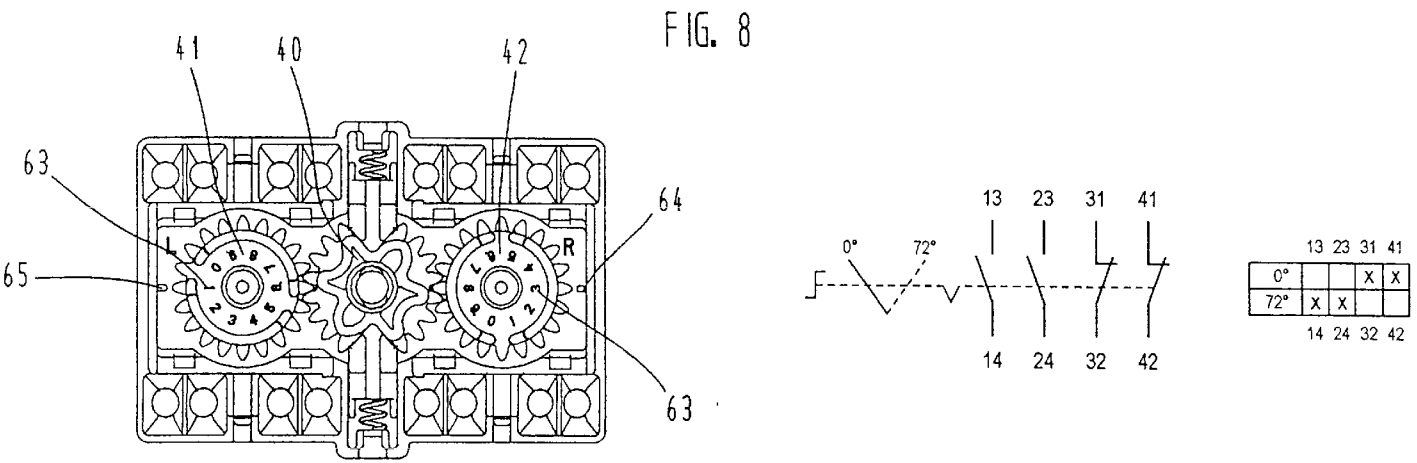
FIG. 8 shows a bottom view of the closure cover and of the gear wheels of the transfer device with a switching picture, wherein the switching gear wheels show one code combination.
Figure 9:
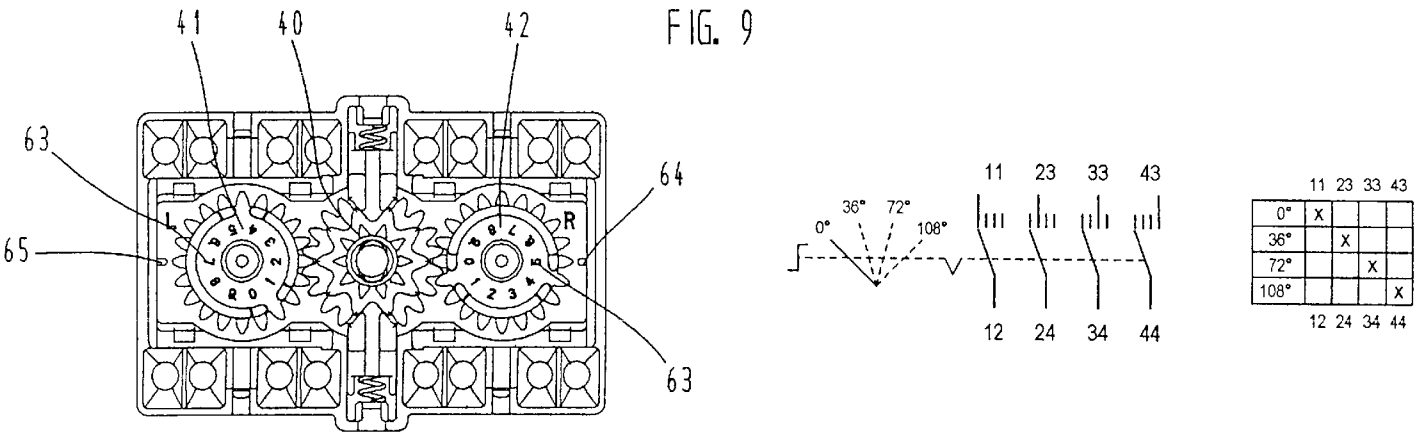
FIG. 9 shows a bottom view of the closure cover and of the gear wheels of the transfer device similar to FIG. 8, however the switching gear wheels show another code combination.

Different switching combinations can be taken as an example from FIGS. 8 and 9, wherein the different switching combinations can be achieved by simple staggering and position changing of the switching gear wheels 41, 42. Further switching combinations can be accomplished by employing different switching gear wheels instead of the switching gear wheels 41, 42 illustrated in the drawing, wherein the different switching wheels have a somewhat different switching crank.

Figure 4:
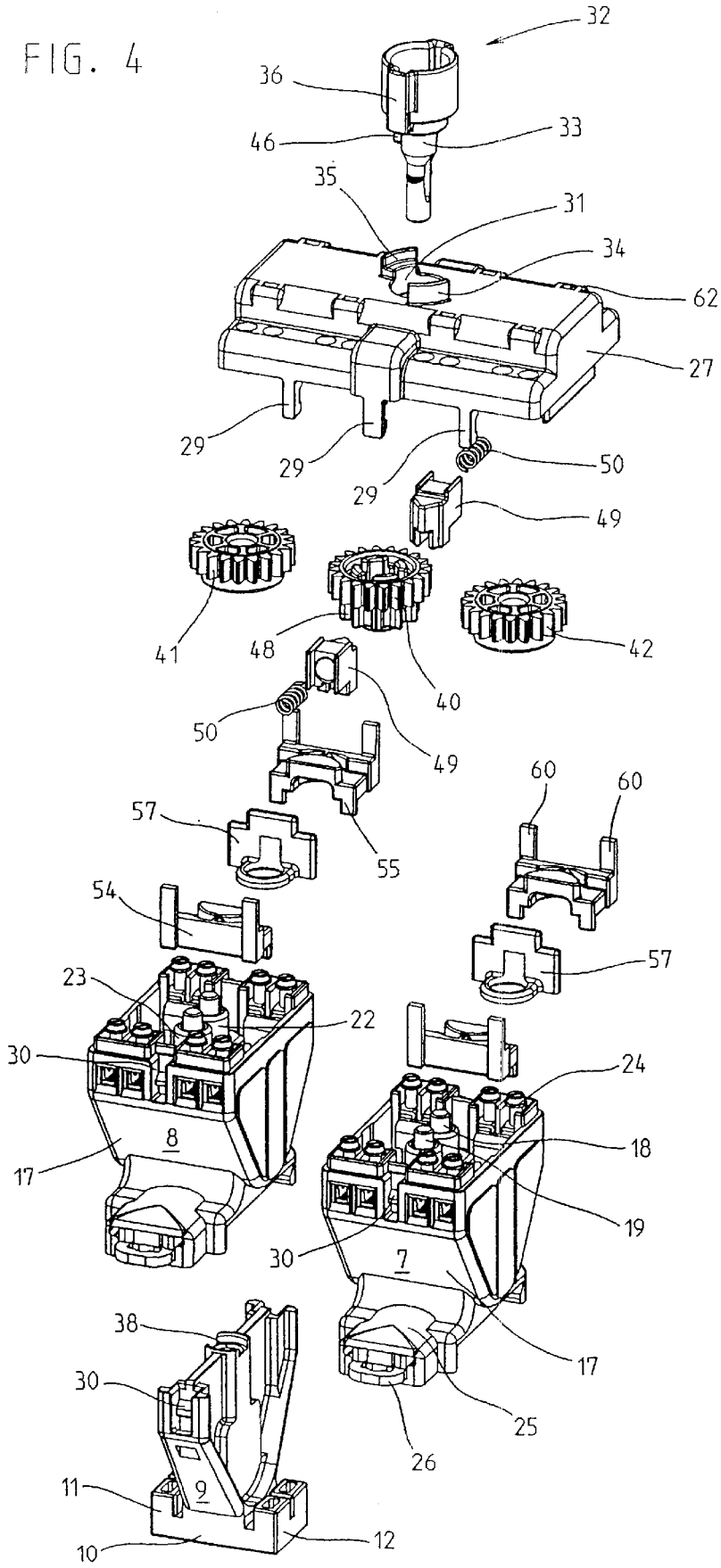
FIG. 4 shows and exploded perspective view of the switching device according to FIG. 1.

If the actuator 16 (FIG. 1) is swivelable, then the drive motion is transferred onto the switching gear wheels 41, 42 (FIG. 4) in a plane disposed perpendicular to the actuating axis. The drive motion is transferred from here by the switching gear wheels 41, 42 (FIGS. 4, 6) of the associated switching crank 51 onto the pressure piece 54, 55 (FIG. 6) and from there to the switching pin 18, 19 (FIG. 4).

An advantage of the variable employable modular building components comprises the very short mounting time and the selective composition of many different switching functions. A further advantage is provided during mounting by the simple plug in and snap in connection technology, wherein no screws or adhesives are required in order to mount the individual parts. It is possible by a sideways and series mounting of several switching modules to combine control switches with a plurality of different switching chambers, wherein for example fourfold, sixfold, or eightfold switching devices can be obtained.

The incorporation and building in of the switching device with the different numbers of switching modules can always be performed with the same, relatively low casing heights, because no different casing heights are required based on the transfer device independent of the number of the switching modules composed and the selected switching combinations.

It will be understood that each of the elements described above, or two or more together, may also find a useful application in other types of switching system configurations and actuation processing procedures differing from the types described above.

While the invention has been illustrated and described as embodied in the context of a switching device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A switching device comprising a plurality of switching modules, wherein each switching module includes:

a switch, connection clamps, an actuator, a transfer device, wherein the transfer device propagates a drive motion initiated by the actuator in a direction perpendicular to the axis of the actuator; and a switching pin, wherein the transfer device transfers the drive motion to the respective switching pin of the switching module, wherein the switching pin is axially shiftable and is disposed parallel to the axis of the actuator and at a distance from the actuator.

2. The switching device according to claim 1, wherein the actuator includes an actuating handle rotatable around the axis of the actuator and an actuating sleeve, wherein the actuating sleeve is pluggably coupled to the actuating handle.

3. The switching device according to claim 2, wherein the actuating sleeve exhibits at least one stop web, wherein the stopweb is swivelable against at least one stop wall, wherein the stop wall is furnished at a closure cover.

4. The switching device according to claim 2, wherein the actuating sleeve exhibits an actuating pin in axial direction, wherein the actuating pin penetrates the closure cover through a bore hole.

5. The switching device according to claim 1 further comprising a closure cover, wherein the transfer device includes a drive gear wheel, and at least two switching gear wheels disposed in a plane with the drive gear wheel and engaging with the drive gear wheel, wherein the switching gear wheels are rotatably supported at the guide pin in the closure cover.

6. The switching device according to claim 5 further comprising an actuating pin having a dog follower nose, wherein the actuating pin engages into a hole of the drive gear wheel and wherein the latter drive gear wheel includes at least one receiver groove for a coupling engagement of the dog follower nose of the actuating pin.

7. The switching device according to claim 5, wherein the drive gear wheel includes drive teeth corresponding to gear teeth of the switching gear wheels and locking teeth disposed coaxially to the drive teeth, wherein at least one locking piece of a switching arrest engages into the locking teeth.

8. The switching device according to claim 5 further comprising a locking piece, a closure cover, wherein the locking piece is supported in the closure cover with a compression spring acting radially against locking teeth of the drive gear wheel.

9. The switching device according to claim 5 further comprising a switching pin associated with the switching module, a pressure piece coordinated to each switching gear wheel for the switching pin of the switching module and coordinated to each one of the at least two switching gear wheels.

10. The switching device according to claim 5, wherein the switching gear wheel includes an about circular shaped switching crank with at least one switching recess at the side disposed toward a pressure piece, wherein the switching recess corresponds to a control cam of the pressure piece.

11. The switching device according to claim 5 further comprising an intermediate wall for guiding two pressure pieces and furnished between the two pressure pieces coordinated to one switching gear wheel.

12. The switching device according to claim 1 further comprising a closure cover, wherein at least one guide web engages into a guide groove for a slidable support of a pressure piece in the closure cover.

13. The switching device according to claim 5, wherein at least one of the two switching gear wheels includes different symbols for a selective switching coding, wherein the symbols of the switching gear wheel are disposed shaped as a circle within the switching crank, wherein at least one coding part for the symbols of the switching gear wheel is formed at a wall of the switching gear wheel.

14. The switching device according to claim 1, wherein the switching module includes a casing supporting the connection terminals.

15. The switching device according to claim 1, wherein two explosion protected switches are mounted such into a casing of the switching module that switching pins protruding out of the guide sleeves are resting with their free ends at pressure pieces of the transfer device.

16. The switching device according to claim 1 further comprising a distance spacer disposed between switching modules, wherein the distance spacer includes a foot part with two sideways protruding support webs, wherein the support webs grip under a casing of the switching module, wherein the distance spacer includes an opening, wherein an actuating pin is guided in the opening;

wherein the casing of the switching module and the distance spacer include locking openings for an engagement of locking hooks, wherein the locking hooks are formed at the closure cover.

17. The switching device according to claim 1 further comprising a closure cover, wherein the closure cover includes a display opening at the end of a guide groove for an end part of a guide web formed at a pressure piece.

18. A switching device comprising two or more switching modules (7, 8, 15) with at least one switch and connection clamps (24), an actuator (16), and a transfer device (39) wherein the transfer device (39) propagates the drive motion initiated by the actuator (16) in a direction perpendicular to the axis of the actuator (16) and transfers the drive motion to at least one switching pin (18, 19) of the switching modules (7, 8, 15), wherein the switching pin (18, 19) is positionable axially at a distance parallel to the axis of the actuator (16).

19. The switching device according to claim 18, wherein the actuator (16) includes an actuating handle (37) rotatable around the axis and an actuating sleeve (32) wherein the actuating sleeve (32) is pluggably coupled to the actuating handle; wherein the actuating sleeve (32) exhibits at least one stop web (36), wherein the stopweb (36) is swivelable against at least one stop wall (35), wherein the stop wall (35) is furnished at a closure cover (27, 28); wherein the actuating sleeve (32) exhibits an actuating pin (33) in axial direction, wherein the actuating pin (33) penetrates the closure cover (27, 28) through a bore hole (31).

20. The switching device according to claim 18, wherein the transfer device (39) includes a drive gear wheel (40) and at least two switching gear wheels (41, 42) disposed in a plane and engaging with the drive gear wheel (40), wherein the switching gear wheels (41, 42) are preferably rotatably supported at a guide pin (43) in the closure cover (27, 28); wherein the actuating pin (33) engages into a hole (45) of a drive gear wheel (40) and wherein the latter drive gear wheel (40) includes at least one receiver groove (47) for the coupling engagement of a dog follower nose (46) of the actuating pin (33); wherein the drive gear wheel (40) includes drive teeth (44) corresponding to the switching gear wheels (41, 42) and locking teeth (48) disposed coaxially to the drive teeth, wherein at least one locking piece of a switching arrest engages into the locking teeth (48); wherein a locking piece (49) is supported in the closure cover (27, 28) with a compression spring (50) acting radially against locking teeth (48) of the drive gear wheel (40); wherein two pressure pieces (54, 55) for the switching pin (18, 19) of the switching module (7, 8) are coordinated to each one of the switching gear wheels (41, 40); wherein the switching gear wheel (41, 42) includes an circular shaped switching crank (51) with at least one switching recess (52, 53) at the side disposed toward the pressure piece (54, 55), wherein the switching recess (52, 53) corresponds to a control cam (56) of the pressure piece (54, 55); wherein an intermediate wall (57) guiding the two pressure pieces (54, 55) is furnished between the two pressure pieces (54, 55) of the one switching gear wheel (41, 42).

21. The switching device according to claim 18, wherein at least one guide web (60) engages into a guide groove (61) for the slidable support of the pressure piece (54, 55) in the closure cover (27, 28); wherein two explosion protected switches are mounted such into the casing (17) of the switching module (7, 8, 15) that the switching pins (18, 19) protruding out of the guide sleeves (22, 23) are resting with their free ends at the pressure pieces (54, 55) of the transfer device (39); wherein the closure cover (27, 28) includes a display opening (62) at the end of the guide groove (61) for the end part of the guide web (60) formed at the pressure piece (54, 55).

22. The switching device according to claim 18, wherein the switching gear wheel (41, 42) includes different symbols (53) for a selective switching coding; wherein the symbols (53) of the switching gear wheel (41, 42) are disposed shaped as a circle within the switching crank (51); wherein at least one coding part (64, 65) for the symbols (63) of the switching gear wheel (41, 42) is formed at a wall of the switching gear wheel (41, 42); wherein the switching module (7, 8, 15) includes a casing (17) supporting the connection terminals (24); wherein preferably two explosion protected switches are mounted such into the casing (17) of the switching module (7, 8, 15) that the switching pins (18, 19) protruding out of the guide sleeves (22, 23) are resting with their free ends at the pressure pieces (54, 55) of the transfer device (39).

23. The switching device according to claim 18, wherein a distance spacer (9, 40) is furnished between the switching modules (7, 8, 15);

wherein the distance spacer (9, 40) includes a foot part (10) with two sideways protruding support webs (11, 12), wherein the support webs (11, 12) grip under the casing (17) of the switching module (7, 8, 15);

wherein the distance spacer (9, 40) includes an opening (38), wherein the actuating pin (33) is guided in the opening (38);

wherein the casing (17) of the switching module (7, 8, 15) and the distance spacer (9, 40) include locking openings (30) for the engagement of locking hooks (29), wherein the locking hooks (29) are formed at the closure cover (27, 28).

24. A switching device, comprising two switching modules (7, 8, 15) with at least one switch and connector (24), an activator (16) and a transfer device (39), which transmits the drive movement introduced by the activator (16) across the axis of the activator (16) and transfers it to at least one switching ram (18, 19) of the switching modules (7, 8, 15), which is axially movable manner at a distance in parallel with the axle of the activator (16).

25. The switching device in accordance with claim 24, wherein the activator (16) exhibits an activation handle that rotates around the axis (37) and an activation shell connected with this in the form of a plug (32).

26. The switching device in accordance with claim 24, wherein the activation shell (32) exhibits at least one stop piece (36), which pivots against at least one stop wall (35), which is provided on a sealing lid (27, 28).

27. The switching device in accordance with claim 24, wherein the activation shell (32) exhibits, axially, an activation pin (33), which passes through the sealing lid (27, 28) in a drilled hole.

28. The switching device in accordance with claim 24, wherein in that the transfer device (39) exhibits a driving toothed wheel (40) and at least two switch toothed wheels (41, 42) intermeshing with this in one plane, which are pivot-borne in the sealing lid (27, 28), preferably on a guiding pin (43).

29. The switching device in accordance with claim 24, wherein the activation pin (33) meshes into a hole (43) of the driving toothed wheel (40) and the latter exhibits at least one reception groove (47) for the coupling meshing of a driving catch (46) of the activation pin (33).

30. The switching device in accordance with claim 24, wherein the driving toothed wheel (40) exhibits a driving toothing (44) and a catch toothing corresponding with the switching toothed wheels (44) and a catch toothing arranged coaxially to this (48), into which at which at least one catch piece (49) of a switch catch meshes.

31. The switching device in accordance with claim 24, wherein the catch piece (49) is arranged with a compression spring (50) acting in a radial direction against the catch toothing (48) of the driving toothed wheel (40) in the sealing lid (27, 28).

32. The switching device in accordance with claim 24, wherein at least one, preferably two thrust pieces (54, 55) for the switching rams (18, 19) of the switching modules (7,8) are assigned to each of the switching toothed wheels (41, 42).

33. The switching device in accordance with claim 24, wherein the switching toothed wheel (41, 42) on the side turned to the thrust piece (54, 55) exhibits an approximately circular switching gate (51) with at least one switch recess (52, 53), which corresponds with a switch cam (56) of the thrust piece (54, 55).

34. The switching device in accordance with claim 24, wherein between the two thrust pieces (54, 55) of the one switching toothed wheel (41, 42), a bearing wall (57) carrying the two thrust pieces (54, 55) is provided.

35. The switching device in accordance with claim 24, wherein for the movable arrangement of the thrust piece (54, 55) in the sealing lid (27, 28), a guide bar (60) is provided that meshes into a guiding groove (61).

36. The switching device in accordance with claim 24, wherein the switch toothed wheel (41, 42) exhibits different symbols for any switch coding selected.

37. The switching device in accordance with claim 24, wherein the symbols (63) of the switch-toothed wheel (41, 42) are arranged in a circular manner within the switching gate (51).

38. The switching device in accordance with claim 24, wherein at least one coding section (64, 65) for the symbols (63) of the switch-toothed wheel (41, 42) is formed on one wall of the sealing lid (27, 28).

39. The switching device in accordance with claim 24, wherein the circuit module (7,8,15) exhibits a housing bearing the connectors (17), in which the switch is supported.

40. The switching device in accordance with claim 24, wherein within the housing (17) of the circuit module (7,8,15) preferably two switches are cast in such a manner in the sense of explosion protection that the switching ramps (18,19) extending out of the guide bushes (22,23) abut, with their free ends, the thrust pieces (54, 55) of the transfer device (39).

41. The switching device in accordance with claim 24, wherein a spacer (9,14) is provided between the circuit modules (7,8,15).

42. The switching device in accordance with claim 24, wherein the spacer (9,14) exhibits a base section (10) with two laterally jutting out holding bars (11,12), which are fastened to the housing (17) of the circuit module (7,8,15).

43. The switching device in accordance with claim 24, wherein the distance (9,14) exhibits an aperture (38), in which the activation pin (33) is conducted.

44. The switching device in accordance with claim 24, wherein the housing (17) of the circuit module (7,8,15) and the spacer (9,14) exhibit catch apertures (30) for the meshing of catch hooks (29), which are formed on, the sealing lid (27,28).

45. The switching device in accordance with claim 24, wherein the closing lid (27, 28) exhibits, at the end of the guide groove (61), a display aperture (62) for the final section of the guide section (60) formed on the pressure piece (54, 55).

* * * * *